US005087026A

United States Patent [19]

Wyer

[11] Patent Number: 5,087,026

[45] Date of Patent: Feb. 11, 1992

[54] SHEET CONVEYING APPARATUS FOR CONVEYING VARIABLE LENGTH SHEETS TO A STACK HAVING A SELECTIVELY POSITIONABLE TRANSPORT ROLLER

[75] Inventor: Andrew F. Wyer, Comberton, United Kingdom

[73] Assignee: Xerox Corporation, Stamford, Conn.

[21] Appl. No.: 708,941

[22] Filed: May 31, 1991

[30] Foreign Application Priority Data

Jun. 28, 1990 [GB] United Kingdom ..... 9014447

[51] Int. Cl.[5] ..... B65H 29/70

[52] U.S. Cl. ..... 271/188; 271/3.1; 271/171; 271/189; 271/198; 271/223; 271/274; 271/275

[58] Field of Search ..... 271/3.1, 171, 188, 198, 271/189, 223, 273, 274, 275

[56] References Cited

U.S. PATENT DOCUMENTS

| | | | |
|---|---|---|---|
| 3,658,320 | 4/1972 | Kuehn | 271/44 R |
| 4,219,191 | 8/1980 | Rastorguyeff | 271/3.1 |
| 4,469,319 | 9/1984 | Robb et al. | 271/3.1 |
| 4,469,436 | 9/1984 | Jones et al. | 271/3.1 X |
| 4,520,977 | 6/1985 | Holzhauser et al. | 248/201 |
| 4,786,039 | 11/1988 | Ito | 271/223 X |
| 5,016,867 | 5/1991 | Kamath | 271/223 X |
| 5,044,623 | 9/1991 | Munz et al. | 271/223 |

FOREIGN PATENT DOCUMENTS

| | | | |
|---|---|---|---|
| 1286921 | 8/1972 | United Kingdom . | |
| 2232406 | 12/1990 | United Kingdom | 271/3.1 |

OTHER PUBLICATIONS

M. C. Hogenes; "Extendible Baffles"; Xerox Disclosure Journal, vol. 11, No. 1, p. 27, Jan./Feb. 1986.

William A. Henry, II; "Automatically Set Side Guides for Document Feeder"; Xerox Disclosure Journal; vol. 11, No. 2, p. 89, Mar./Apr. 1986.

*Primary Examiner*—Robert P. Olszewski
*Assistant Examiner*—Boris Milef
*Attorney, Agent, or Firm*—William A. Henry, II

[57] ABSTRACT

Sheet feeding apparatus for a buffer tray of a xerographic reproduction machine comprises a belt for conveying sheets to the tray, input and output rolls which co-operate with the belt at the input and the output respectively of the apparatus, and an intermediate roll which can co-operate with the belt at a point intermediate its length. The output roll is mounted on an end guide of the buffer tray and, as a result, moves lengthwise of the belt when the end guide is moved to enable the tray to receive sheets of different lengths. If the output roll is moved from one side of the intermediate roll, remote from the input roll, to the other, it causes the intermediate roll to move to an inoperative position (in which it does not co-operate with the belt) and operates a latch to hold the intermediate roll in that position. The reverse movement of the output roll releases the latch and allows the intermediate roll to return to the position in which it co-operates with the belt.

11 Claims, 6 Drawing Sheets

SHEET CONVEYING APPARATUS FOR CONVEYING VARIABLE LENGTH SHEETS TO A STACK HAVING A SELECTIVELY POSITIONABLE TRANSPORT ROLLER

The present invention relates to sheet feeding apparatus and, more especially, to apparatus for feeding sheets in succession to a stacking location. The invention is especially, but not exclusively, applicable to sheet feeding apparatus for use in reprographic machines.

The stacking of sheets (both copy sheets and original documents) is an important operation in reprographic machines and in document handling generally. In a reprograhic machine, for example, original documents are re-stacked in the tray of a recirculating document handler after they have been copied and completed copies are stacked in an output tray of the machine. Within the machine itself, duplex copies may be stacked in an intermediate storage (or duplex buffer) tray between the two printing operations that are required to place images on both sides of the copy sheets. Frequently, a tray in which documents are stacked in this manner is adjustable to accommodate sheets of different sizes: such adjustment may require a corresponding adjustment to be made to the sheet feed path through the apparatus that supplies sheets to the tray and arrangements for achieving this are known.

For example, U.S. Pat. No. 4,219,191 describes a sheet feeding apparatus for a buffer tray, comprising co-operating upper and lower belts between which documents are fed to the tray. The location of the downstream end of the lower belt and the location of an adjacent wall of the tray can be changed to enable the tray to receive documents of different lengths. The "Xerox Disclosure Journal" Volume 11, No. 1, page 27 describes a recirculating document feeder for a copier, in which documents are guided to the feed roll nip of a restack tray between flexible baffles. The baffles unroll automatically, thereby extending their length, when the rear guide of the tray is moved forward to adjust the tray for smaller documents (and vice versa for larger documents). U.S. Pat. No. 4,469,319 describes a recirculating document handler for a copier, in which the restack tray has an adjustable rear guide which is moved when the tray is required to accommodate documents of a different size. Movement of the rear guide automatically adjusts the feed path to the tray by adjusting movable baffles which are integral with the rear guide.

Other patents include GB 1,286,921 which discloses a stacking device for stacking documents diverted from a conveyor in a predetermined location into a magazine. The operative length of the endless belt conveyor has variable angular positioning in order to maintain an operative configuration with the magazine that receives the documents. U.S. Pat. No. 4,520,977 describes a document feeder which has two pivotal axes 38, 44 so that is can be moved away from the platen in two steps: the first step is sufficient to allow single sheets to to be placed on the platen and the second moves the document feeder enven further away from the platen so that, e.g., pages of a book can be copied. U.S. Pat. No. 3,658,320 describes a sheet feeder with adjustable back stops 22 which enable different sheet sizes to be accommodated. Movement of the back stops is accompanied by a height adjustment. Xero Disclosure Journal, Volume 11, No. 2, page 89 describes automatic adjustment of side and end guides of a tray of a document feeder.

It is an object of the present invention to provide sheet feeding apparatus which can be used for feeding sheets to a stacking location; which is of comparatively simple construction, and which will readily accommodate adjustments in the size of the stacking tray.

The present invention provides sheet feeding apparatus comprising a belt for conveying sheets through the apparatus; an input roll and an output roll which co-operate with the belt at the input and the output of the apparatus respectively, the output roll being movable lengthwise of the belt to vary the length of the sheet feed path through the apparatus; an intermediate roll which is movable between an operative position in which it co-operates with the belt at a point intermediate the ends thereof and an inoperative position in which it does not co-operate with the belt; and latch means operable to hold the intermediate roll in the inoperative position, the output roll being co-operable with the intermediate roll whereby: movement of the output roll from a position on one side of the intermediate roll, remote from the input roll, to a position on the other side of the intermediate roll moves the intermediate roll into the inoperative position and operates the said latch means; and the reverse movement of the output roll releases the latch means and allows the intermediate roll to return to the operative position.

The intermediate roll may be resiliently biased into the operative position.

The latch means may be mounted in a housing on which the intermediate roll is located, the latch means projecting from the housing when operated and being wholly contained within the housing when released. The housing may be pivotally-mounted in a support surface, in which case the latch means, when operated, may be engageable with the surface to hold the intermediate roll in the inoperative position. The apparatus may include latch-operating means which are coupled to the latch means and project from the housing for engagement by a latch-operating member movable with the output roll. The latch means may comprise a pair of disc rotatably mounted in the housing, each disc being cut away at one side so that the disc does not project from the housing when the latch means is released.

Preferably, the apparatus includes means for imparting a curved/corrugated configuration to sheets which are conveyed through the apparatus, the curved/corrugated configuration being in a direction transverse to the direction of travel of the sheet.

Apparatus in accordance with the invention may form part of a sheet stacking arrangement which also includes a stacking location arranged to receive sheets from the feeding apparatus, the output roll of the feeding apparatus being moved lengthwise of the belt when the stacking location is adapted to receive sheets of a different length. The stacking location may have an end guide which is movable to adapt the stacking location to receive sheets of different lengths, the output roll being movable with the end guide. The stacking location may be a tray, the end guide being movable to adjust the length of the tray.

By way of example, sheet feeding apparatus constructed in accordance with the invention will now be described with reference to the accompanying drawings, in which.

The sheet feeding apparatus described below is associated with the duplex buffer tray of a copier although it could be used in other situations when sheets are to be stacked in a location to which they are fed one after another. A duplex buffer tray is provided in a copier when duplex copies are to be produced and its function will be described briefly with reference to FIG. 1.

Figure 1:
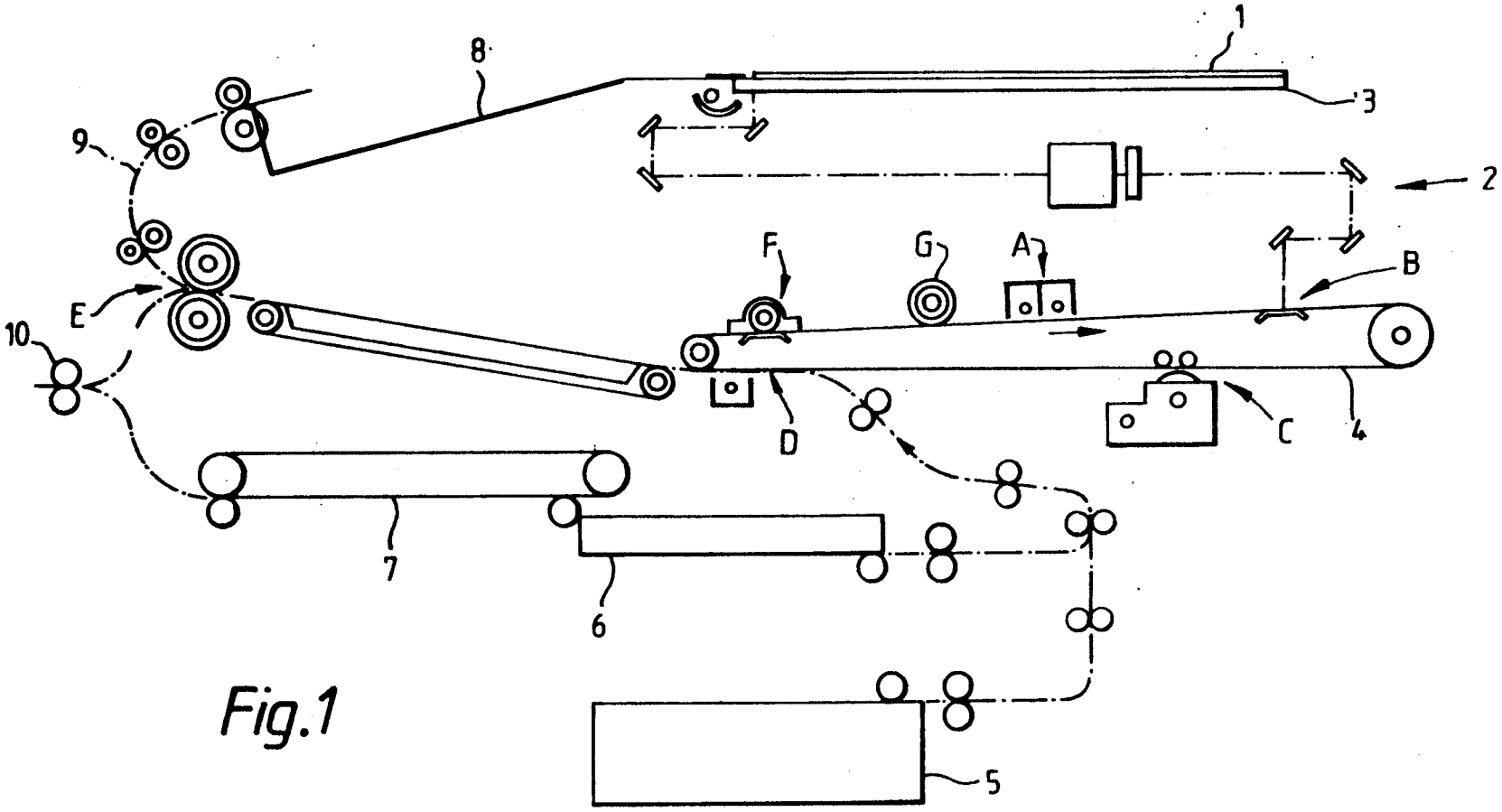
FIG. 1 is a diagrammatic side view of a xerographic copier incorporating a duplex buffer tray.

In the copier shown in FIG. 1, original documents are fed, one after another (for example by a recirculating document handler, not shown) to the platen 3 of the copier. When a document 1 is on the platen 3, an electrostatic latent image of the document is formed at an exposure station B on the photoreceptor belt 4 of the copier. The image is formed by an imaging system indicated generally at 2 and, thereafter, the document is returned to a storage tray (not shown).

Also associated with the photoreceptor belt 4 are a charging station A at which the belt is charged to a relatively high uniform potential upstream of exposure station B; a development station C at which the latent image is developed with toner particles; a transfer station D at which the toner image is transferred to a copy sheet; and a cleaning station F at which residual toner particles are removed from the belt 4 which is then illuminated by a lamp G to remove any residual charge before the start of the next cycle. These operations are all well known and need not be described in detail.

A tray 5 is provided to hold a supply of clean copy sheets onto which images of the documents fed to platen 3 are to be printed. Sheets are fed from the tray 5 to the transfer station D at the photoreceptor belt 4 and, following the transfer of a toner powder image from the photoreceptor, each sheet is then fed to a fusion station E where the transferred image is fused to the sheet. From the fusing station E, copy sheets will be deflected either to a duplex buffer tray 6 via a belt feeder 7 or to the copier output tray 8 via an output path 9.

Sheets deflected to the duplex tray 6 travel via an inverter (of which only the inverter nip 10 is shown) so that they are stacked image face up in the tray, in the order in which they were printed. They are then fed from the bottom of the stack back to the transfer station D at the photorceptor belt 4, for the transfer of an image to the second side. The now-duplexed copy sheets are then fed into the output path 9 of the copier and finally to the output tray 8.

Further description of the copier is not required for an understanding of the sheet feeding apparatus 7 which will now be described in greater detail with reference to FIGS. 2 to 9.

Figure 2:
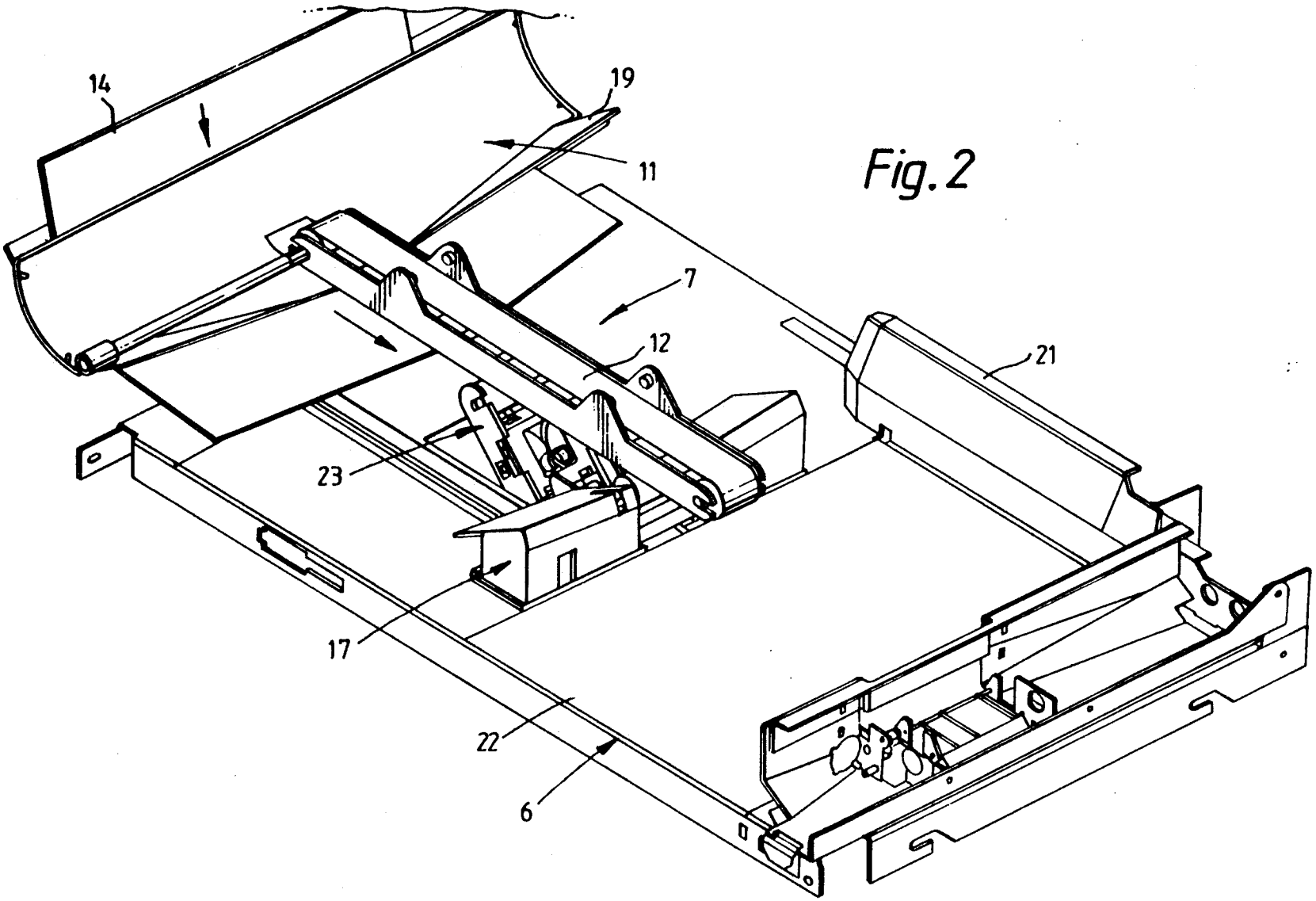
FIG. 2 is a perspective view of the duplex buffer tray of FIG. 1 and the associated sheet feeding apparatus.
Figure 3:
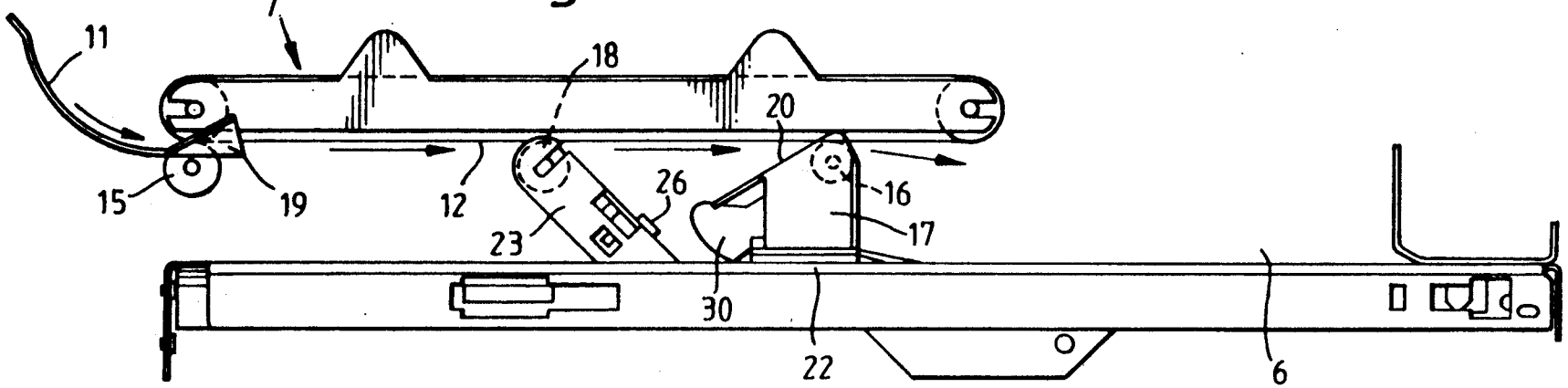
FIG. 3 is a diagrammatic side view of the tray and sheet feeding apparatus of FIG. 2.

Referring to FIGS. 2 and 3, it can be seen that copy sheets 14 pass to the belt feeder 7 via a curved guide 11. The belt feeder 7 comprises a narrow belt 12 which passes around a driven roll at one end and an idler roll at the other end. At the upstream end of the feeder, the belt 12 co-operates with an input idler roll 15 and, at the downstream end, it co-operates with an output idler roll 16. The position of the input roll 15 is fixed but the output roll 16 is carried by the trail edge guide 17 of the duplex tray 6 and is movable therewith as will be described below. Located between the input and output rolls 15, 16 is an intermediate idler roll 18 which will also be described below.

As indicated by the arrows in FIG. 3, an incoming sheet to the belt feeder 7 passes between the belt 12 and the input roll 15, is taken up successively by the intermediate roll 18 and the output roll 16, and is then fed out into the tray 6. Adjacent the input and output rolls 15, 16 the sheet passes over, and is curved upwardly by, corrugating baffles 19, 20 respectively. The curved configuration imparts beam strength to the sheet as it moves through the belt feeder 7 and out over the tray 6, enabling a reduced amount of support to be used in the feeder and ensuring accurate stacking in the tray.

The tray 6 has movable side guides 21 (only one of which is shown) as well as the movable trail edge guide 17, and the floor 22 of the tray extends underneath the belt 12 as far as the input roll 15. The guides 17, 21 are adjusted to alter the size of the tray 6 and it will be seen from FIG. 3 that adjustment of the trail edge guide 17 is accompanied by movement of the output point of the belt feeder 7 (defined by the position of the output roll 16). More specifically, if the rear edge guide 17 is moved to the left from the position shown in FIG. 3, to increase the length of the tray 6, the length of the sheet feed path through the feeder 7 is automatically decreased and vice versa.

As the length of the tray 6 is increased, to enable the tray to receive longer sheets, the output roll 16 approaches the intermediate roll 18 and the additional support provided by the latter becomes redundant because the sheets are now able to bridge the distance between the input and output rolls 15, 16 To enable the length of the tray to be increased further, the intermediate roll 18 is mounted in a housing 23 which can be pushed down into the floor 22 of the tray by the approaching trail edge guide 17. The trail edge guide 17 can then be moved over the top of the retracted housing 23, bringing the output roll 16 closer to the input roll 15 and shortening the sheet path through the belt feeder 7. As the trail edge guide 17 passes over the retracted housing 23, it actuates a latch to hold the housing in the retracted position. The manner in which that is achieved will be described in greater detail below.

Figure 4:
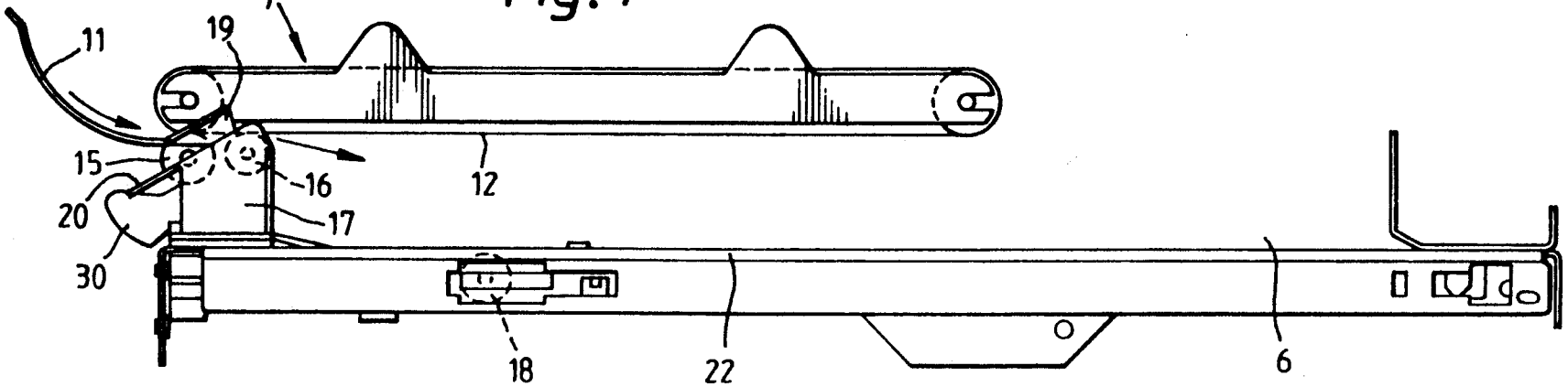
FIG. 4 is similar to FIG. 3 but shows the tray adjusted to receive larger sheets.

FIG. 4 shows the stacking apparatus when the output roll 16 is located adjacent the input roll 15, the length of the tray 6 then being at a maximum. The housing 23 remains latched in the retracted position until the length of the tray 6 is shortened again. As the trail edge guide 17 is moved back over the retracted housing 23, the latch is released and the housing lifts up again to bring the intermediate roll 18 back into operation before the distance between the input and output rolls 15, 16 exceeds the length of the sheets that are being fed to the tray 6.

The manner in which the trail edge guide 17 co-acts with the intermediate roll 18 will now be described.

Figure 5:
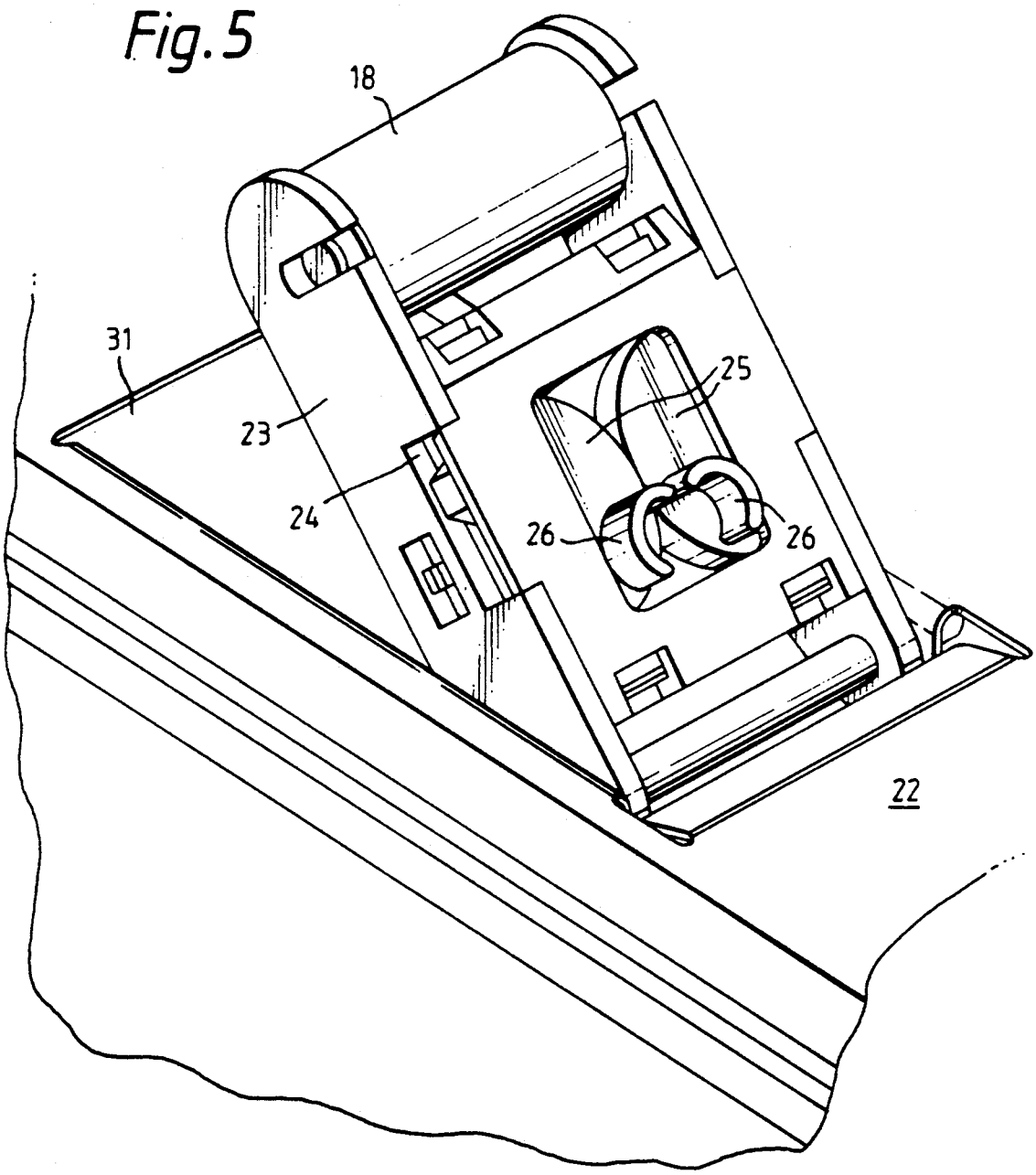
FIGS. 5 and 6 are perspective views of a component of the sheet feeding apparatus in the positions shown in FIGS. 3 and 4 respectively.
Figure 6:
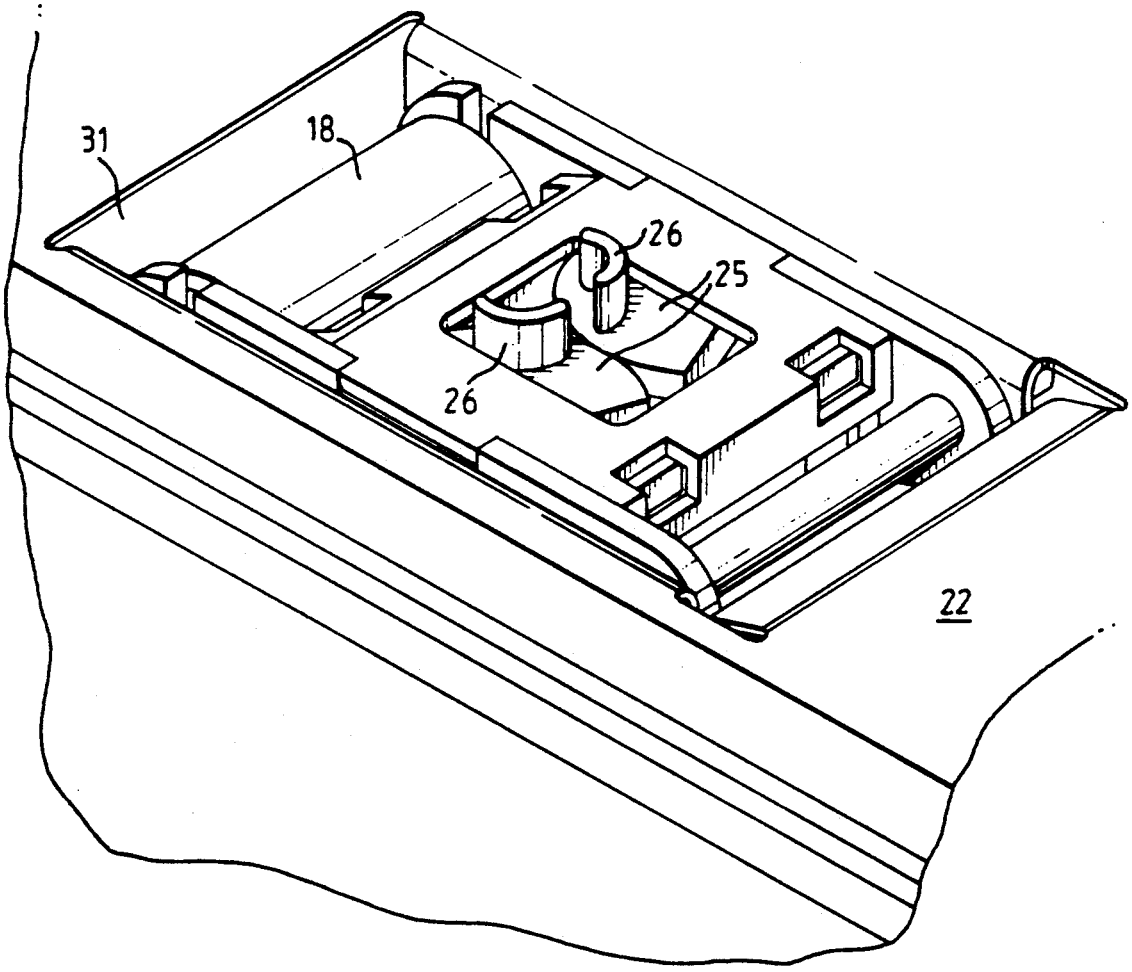
Figure 7:
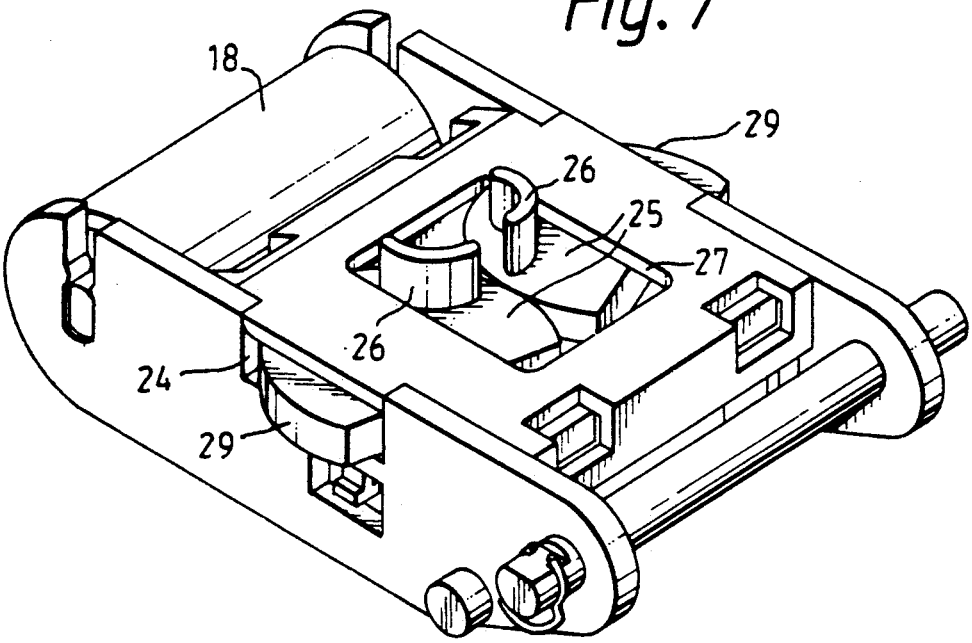
FIG. 7 is similar to FIG. 6 but shows the component removed from the surrounding apparatus.
Figure 8:
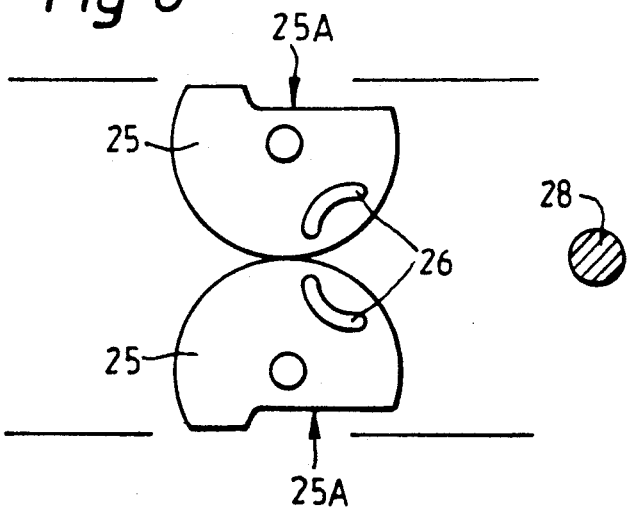
FIGS. 8 and 9 are plan views of a part of that component in the positions shown in FIGS. 5 and 6 respectively.
Figure 9:
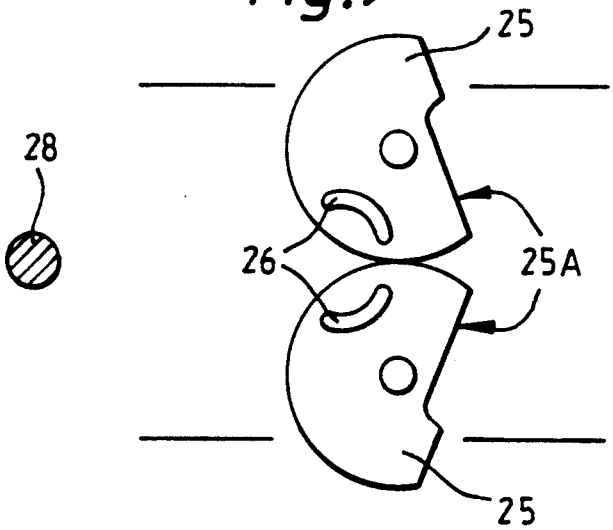

The housing 23, on which the intermediate roll is mounted, is pivotally mounted in the floor 22 of the tray 6 and is biased by a spring (not shown) into the raised position shown in FIGS. 3 and 5. Rotatably mounted within the housing are two latch members 25 each of which is in the form of a disc which is cut away at one side 25A (see FIGS. 8 and 9). The latch discs 25 are geared together (not shown) and each carries a curved projection 26 which extends upwards through a window 27 in the housing 23. The projections 26 are so positioned that they lie in the path of a downwardly-extending pin 28 on the underside of the trail edge guide 17. The pin 28 itself does not appear in the drawings but its position relative to the latch members is shown in FIGS. 8 and 9. As described below, engagement of the projections 26 by the pin 28 causes the latch discs 25 to rotate between an unlatched position, shown in FIGS. 3, 5 and 8, and a latched position, shown in FIGS. 4, 6, 7 and 9. In the latched position, a portion 29 of each disc projects through an opening 24 in the adjacent side of the housing 23. In the unlatched position, the cut-away side 25A of each disc is aligned with the adjacent opening 24 so that the discs are wholly contained within the housing 23.

The trail edge guide 17 carries two spaced-apart arms 30 on the side facing the input roll 15 (only one of the arms 30 being visible in FIGS. 3 & 4). When the trail edge guide 17 is moved from the FIG. 3 to the FIG. 4 position, the arms 30 engage the housing 23 of the intermediate roll 18 (passing on the outside of the projections 26) and push the housing down into an opening 31 in the floor 22 of the tray 6, against the action of the spring 24. As the trail edge guide passes over the retracted housing 23, the pin 28 engages the upstanding projections 26 on the latch discs 25 and rotates the discs from the unlatched to the latched position. The portions 29 of the latch discs 25 now project out of the housing 23 and engage underneath the floor 22 of the tray 6, so that the housing 23 is held in the retracted position. When the trail edge guide 17 is moved back again to the FIG. 3 position, the pin 28 again engages the upstanding projections 26 and rotates the discs 25 back to the unlatched position. Because the latch discs no longer project from the housing of the mid-point roll and no longer engage under the floor 22 of the tray 6, the housing 23 is free to move upwards under the action of the spring 24 once the arms 30 of the trial edge guide 17 have passed overhead.

It will be appreciated that use of a belt feeder with a mid-point idler similar to that described above is not restricted to stacking apparatus incorporating a duplex tray. A similar belt feeder could be used at other stacking locations: for example, it could be used during colour printing in apparatus for stacking sheets that are to be returned to the transfer station 6 at the photoreceptor (FIG. 1) for further printing in a different colour on the side that already carries an image. In that case, the sheets would not be inverted before being stacked.

I claim:

1. Sheet feeding apparatus having an input and an output ends thereof and a sheet feed path, comprising: a belt for conveying sheets through the appartatus; an input roll and an output roll which co-operate with said belt at said input and said output ends of said apparatus, respectively, said output roll being movable lengthwise of said belt to vary the length of said sheet feed path through said apparatus; an intermediate roll which is movable between an operative position in which it co-operates with said belt at a point intermediate the ends thereof and an inoperative position in which it does not co-operate with said belt; and latch means operable to hold said intermediate roll in said inoperative position, said output roll being co-operable with said intermediate roll whereby: movement of said output roll from a position on one side of said intermediate roll, remote from said input roll, to a position on the other side of said intermediate roll moves said intermediate roll into said inoperative position and operates said latch means; and the reverse movement of said output roll releases said latch means and allows said intermediate roll to return to said operative position.

2. The apparatus as claimed in claim 1, including a housing, and wherein said latch means is mounted in said housing and on which said intermediate roll is located, said latch means projecting from said housing when operated and being wholly contained within said housing when released.

3. The apparatus as claimed in claim 2, inlcuding a support surface, and wherein said housing is pivotally-mounted in said support surface, and wherein said latch means, when operated, is engageable with said support surface to hold said intermediate roll in said inoperative position.

4. The apparatus as claimed in claim 3, in which said intermediate roll projects above said support surface when in said operative position and is retracted below said support surface when in said inoperative position.

5. The apparatus as claimed in claim 4, including latch-operating means which are coupled to said latch means and project from said housing for engagement by a latch-operating member movable with said output rolls.

6. The apparatus as claimed in claim 5, in which said latch means comprises a pair of discs rotatably mounted in said housing, each disc being cut away at one side so that the disc does not project from said housing when said latch means is released.

7. The apparatus as claimed in claim 6, including means for imparting a curved/corrugated configuration to sheets which are conveyed through said apparatus, the curved/corrugated configuration being in a direction transverse to the direction of travel of the sheet.

8. The apparatus as claimed in claim 1, including a stacking location arranged to receive sheets for stacking, and wherein said output roll of said feeding apparatus is moved lengthwise of said belt when said stacking location is adapted to receive sheets of a different length.

9. The apparatus of claim 8, in which said stacking location includes an end guide which is movable to adapt said stacking location to receive sheets of different lengths, said output roll being movable with said end guide.

10. The apparatus as claimed in claim 9, in which said stacking location is a tray and said end guide is movable to adjust the length of said tray.

11. In a printing apparatus adapted to make copies of page image information and stacking the copies of the page image information in a stacking apparatus with the stacking apparatus having an input and an output ends thereof and a sheet feed path, the improvement of the stacking apparatus, characterized by: a belt for conveying sheets through the apparatus; an input roll and an output roll which co-operate with said belt at said input and said output ends of said stacking apparatus, respectively, said output roll being movable lengthwise of said belt to vary the length of said sheet feed path through said stacking apparatus; an intermediate roll which is movable between an operative position in which it co-operates with said belt at a point intermediate the ends thereof and an inoperative position in which it does not co-operate with said belt; and latch means operable to hold said intermediate roll in said inoperative position, said output roll being co-operable with said intermediate roll whereby: movement of said output roll from a position on one side of said intermediate roll, remote from said input roll, to a position on the other side of said intermediate roll moves said intermediate roll into said inoperative position and operates said latch means; and the reverse movement of said output roll releases said latch means and allows said intermediate roll to return to said operative position.

* * * * *